US006478529B1

(12) United States Patent
Willey et al.

(10) Patent No.: US 6,478,529 B1
(45) Date of Patent: Nov. 12, 2002

(54) RECLINING PLATFORM WHEELCHAIR SUPPORT

(75) Inventors: Leone V. Willey; Donald L. Willey, both of Jamestown, ND (US); Robert G. Willey, Fort Wayne, IN (US)

(73) Assignee: Wheelchair Recline, Inc., Fort Wayne, IN (US)

( * ) Notice: Subject to any disclaimer, the term of this patent is extended or adjusted under 35 U.S.C. 154(b) by 0 days.

(21) Appl. No.: 09/521,088

(22) Filed: Mar. 7, 2000

(51) Int. Cl.[7] ..... B63C 3/12

(52) U.S. Cl. ..... 414/678; 414/639; 414/628; 414/781; 297/310

(58) Field of Search ..... 414/639, 678, 414/921, 786, 778, 781, 608, 628, 662; 410/630; 297/310; 280/250.1

(56) References Cited

U.S. PATENT DOCUMENTS

| | | | | | |
|---|---|---|---|---|---|
| 4,830,567 | A | * | 5/1989 | Rachman | 414/678 |
| 4,834,411 | A | * | 5/1989 | Willey et al. | 280/250.1 |
| 4,898,256 | A | * | 2/1990 | Lehner | 180/8.2 |
| 4,918,767 | A | * | 4/1990 | Benting | 4/517 |
| 4,941,799 | A | * | 7/1990 | Gordon et al. | 414/678 |
| 5,040,939 | A | * | 8/1991 | Booth | 414/678 |
| 5,144,701 | A | * | 9/1992 | Clark | 4/515 |
| 5,287,568 | A | * | 2/1994 | Mohrmann | 4/561.1 |
| 5,421,693 | A | | 6/1995 | Petersen | 414/678 |
| 5,472,307 | A | * | 12/1995 | Kadlec et al. | 414/678 |
| 6,135,480 | A | * | 10/2000 | James | 280/340.1 |

FOREIGN PATENT DOCUMENTS

| | | | | |
|---|---|---|---|---|
| WO | WO 89/02867 | * | 4/1989 | 414/678 |

* cited by examiner

*Primary Examiner*—Joseph A. Fischetti
(74) *Attorney, Agent, or Firm*—Westman, Champlin & Kelly, P.A.

(57) ABSTRACT

A reclining support for a wheelchair includes a supporting platform wall that supports all four wheels of a wheelchair on a surface, and which has a backstop wall for stopping the large rear wheels of a wheelchair so that the wheelchair is stably supported on the platform. Clamps are used for holding the frame on the platform, so that the wheelchair does not move. The platform is mounted onto a base frame through a pivot mounting so it can be tilted rearwardly, and also the platform is adjustable in a vertical direction relative to the base frame. The base frame has four wheels for stably supporting the platform.

16 Claims, 6 Drawing Sheets

RECLINING PLATFORM WHEELCHAIR SUPPORT

BACKGROUND OF THE INVENTION

The present invention relates to a reclining platform wheelchair support on which a wheelchair can be mounted, and the platform is pivotally mounted on a support frame for reclining the wheelchair and a seated patient in the wheelchair for various operations such as dental work, hair shampooing, or medical inspections of eyes, ears, nose and throat.

U.S. Pat. No. 4,834,411 shows a reclining wheelchair used for shampooing the hair of patients, and includes a frame that has two pivoting portions operated with a power actuator between the frame portions. In prior patent, '411, clamps are made for clamping directly onto the frame of the wheelchair. U.S. Pat. Nos. 5,040,939; 5,421,693 and 5,472,307 show wheelchair lifts that also tilt.

SUMMARY OF THE INVENTION

The present invention relates to a support platform for supporting a wheelchair so that all of the wheels of the wheelchair are supported on a platform surface. The platform is pivotally mounted onto a mobile base frame at the rear of the platform about a horizontal pivot axis. A power actuator of selected design is utilized for moving the platform about its pivotal mounting from a generally horizontal position, that is very close to the floor so that a wheelchair can be rolled onto the platform, and a pivoted, rearwardly tilted position. When the platform and wheelchair supported thereon are tilted, the patient or occupant of the wheelchair is then inclined rearwardly so that the patient can receive attention around the head without getting out of the wheelchair, such as a shampoo or inspection and treatment to the head, mouth and face by a doctor or dentist.

The support platform is very stable, utilizing a four wheel support for the frame. The platform has supports that are made stable to insure confidence in the occupant. The wheelchair can be anchored securely onto the platform using straps or brackets. The platform includes a rear stop wall for the large wheels of the wheelchair so as the platform tilts rearwardly, the walls insure the wheelchair will not roll off.

The anchoring devices can be adjustable straps so they will go directly onto the frame and be readily adapted to attach to substantially any frame of a wheelchair that is presently be marketed, and thus provides for very quick universal operation for various wheelchair configurations. Hooks for the wheels also can be provided.

The tilting base can be mounted onto caster wheels or any type of support desired. The base is kept close to the ground, so that the wheelchair can be moved onto the support base very easily.

The tilting platform is adjustably mounted in a vertical direction relative to the support frame, so that it can be adjusted for different patients and sink heights for shampooing, and also adjusts up and down for dental work to the appropriate height desired by the dentist.

The support thus is readily adaptable to various wheelchairs, and has wider versatility.

DETAILED DESCRIPTION OF THE ILLUSTRATIVE EMBODIMENTS

Figure 5:
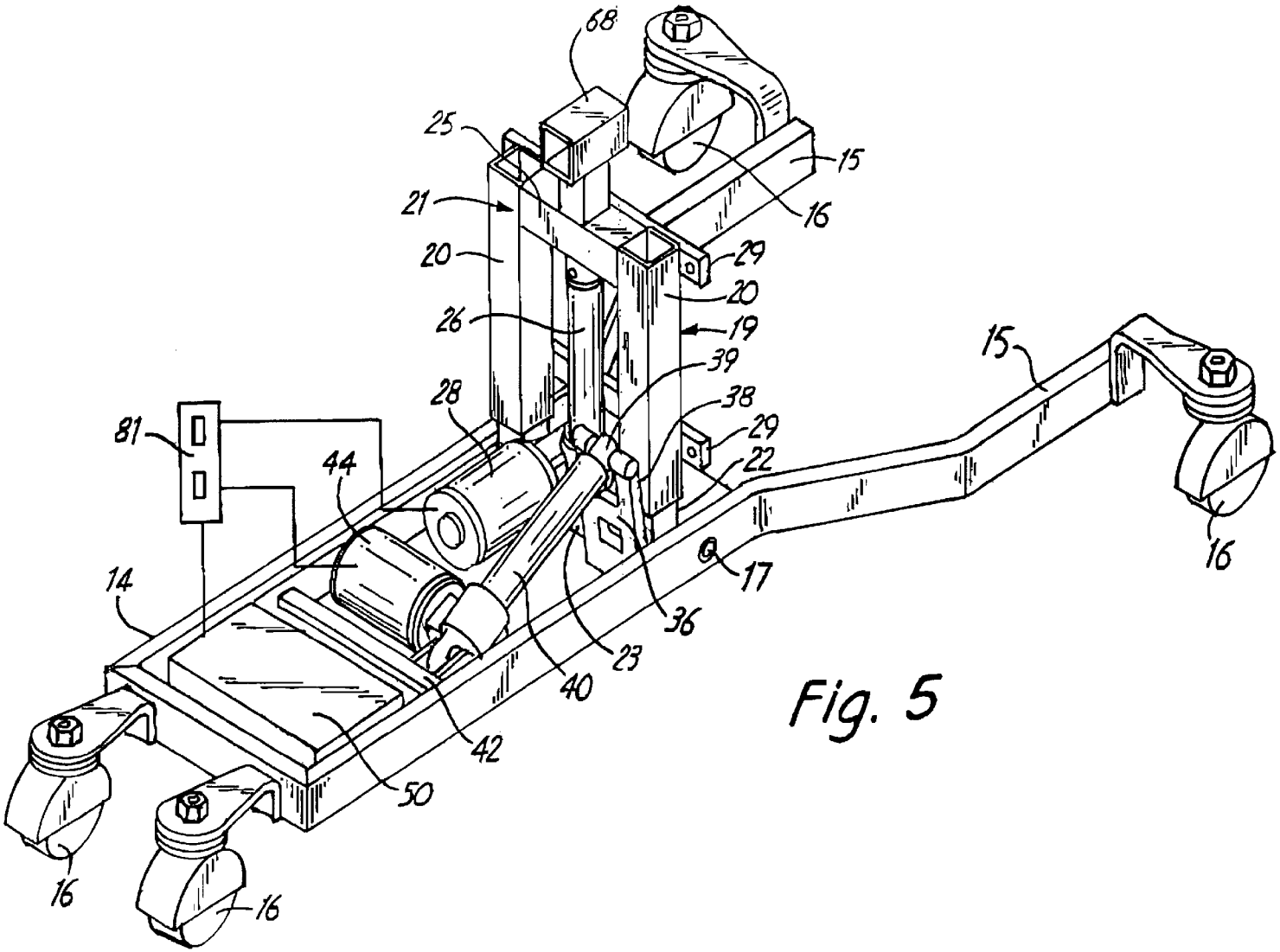
FIG. 5 is a top perspective view of the frame for the wheelchair support of the present invention with the wheelchair platform removed.
Figure 6:
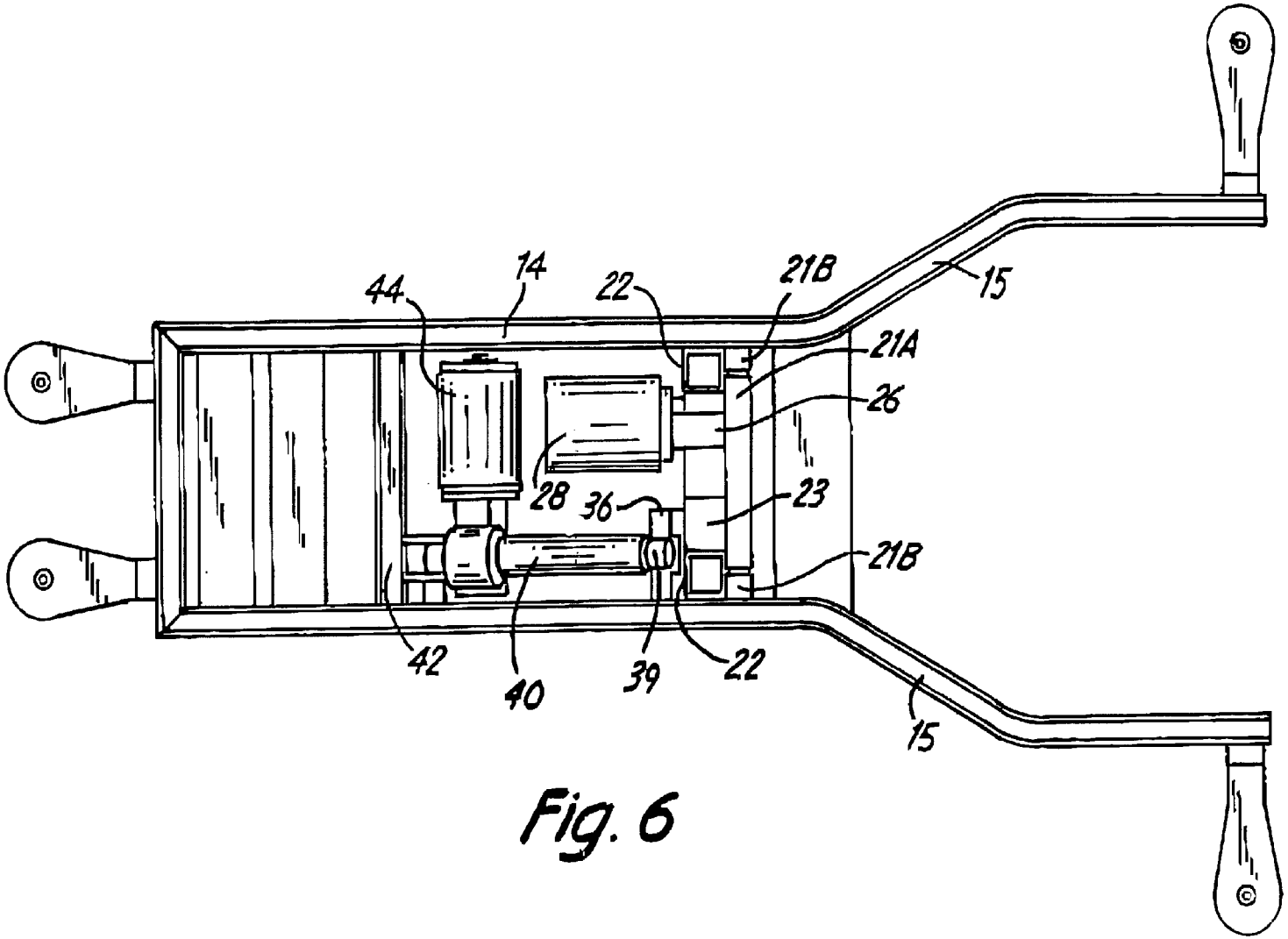
FIG. 6 is a fragmentary plan view of the frame, shown in FIG. 5.

A wheelchair support illustrated generally at 10 comprises a pivoting frame 12 mounted onto a support frame 14 (see FIGS. 5 and 6). The support frame 14 has rearward frame extensions 15 for stability. The support frame 14 is mounted onto four caster wheels 16, so that the wheelchair support can be easily maneuvered along a supporting surface. The caster wheels 16 are of the type that can be locked from rotation so that the support frame 14 can remain very stable and non moving when desired, but can be released to permit rolling movement.

Figure 3:
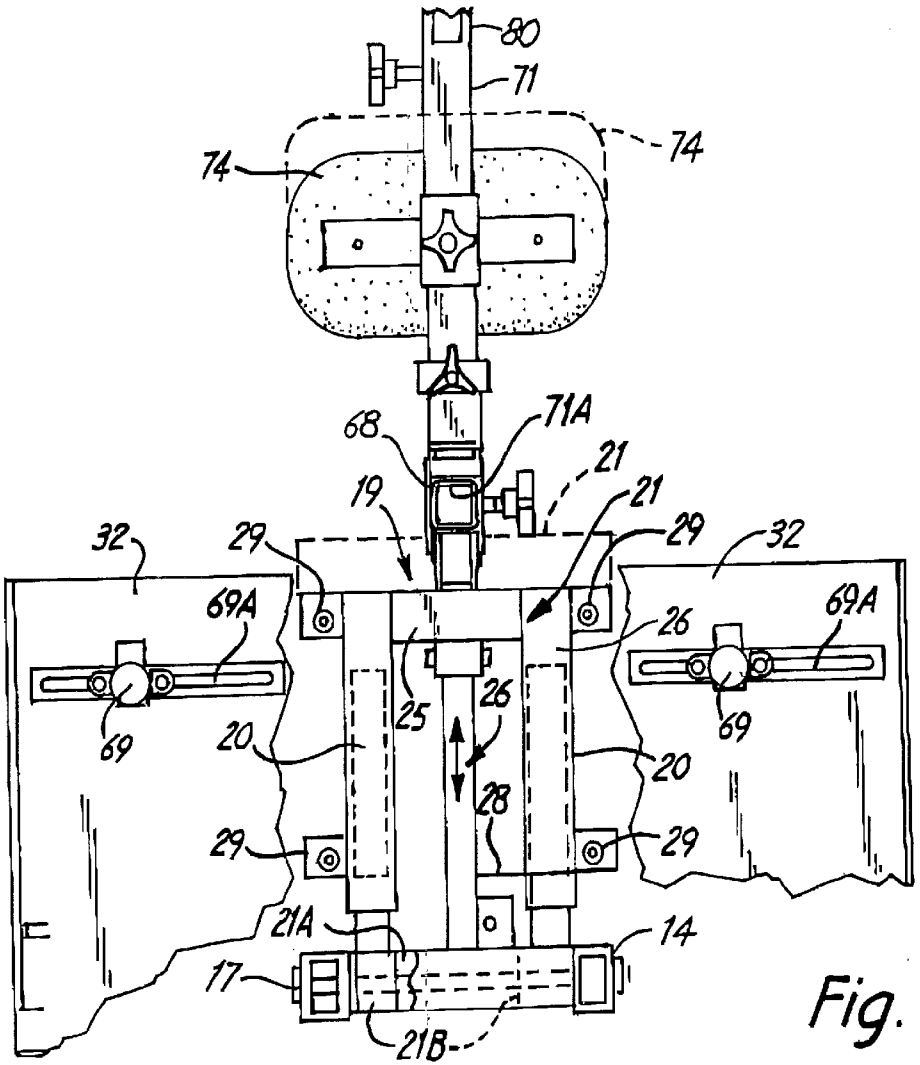
FIG. 3 is a rear elevational view of the wheelchair of FIG. 1 with parts broken away.
Figure 4:
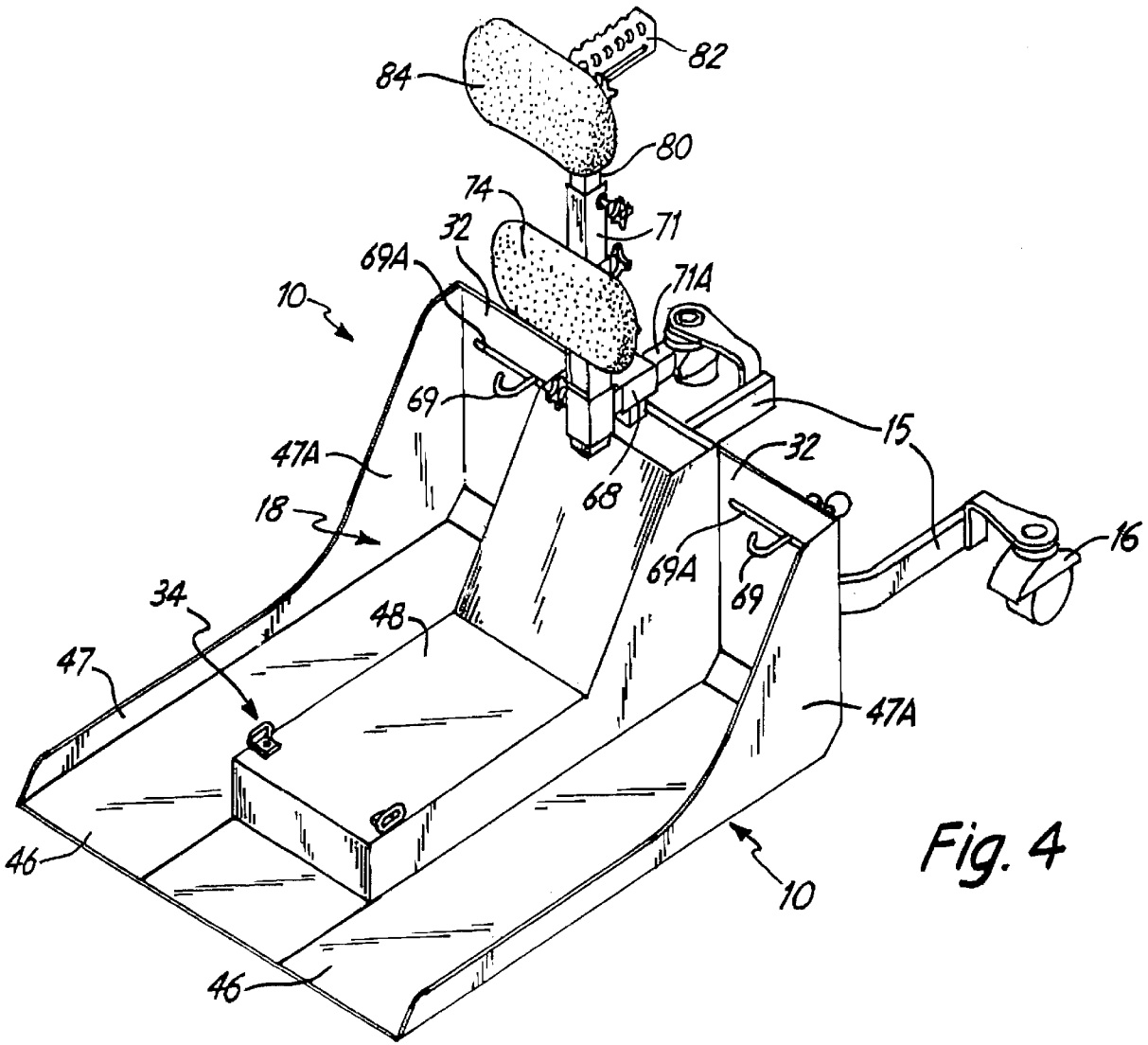
FIG. 4 is a front perspective view of the wheel chair support of FIG. 1.

The pivoting frame 12 is mounted on the support frame 14 on a pivot pin 17 close to the floor and at the rear of pivoting frame 12. The pivoting frame includes a wheelchair platform section 18 that is mounted on a bracket 19 that is connected to frame 14 with the pin 17. The bracket 19 includes a pair of upright tubular supports or tubes 22 fixed to a lower cross member 23. The lower cross 23 has a housing 21A that pivots on pin 17 and is positioned between hubs 21B on the side frame members. (See FIGS. 3 and 6). The wheelchair platform section 18 includes a telescoping frame 21 that has a pair of spaced sleeves 20 that are held together with a cross member 25 at the top. The sleeves slide over or telescope on the upright tubes 22. A linear (ball screw) actuator 26 is driven with a reversible motor 28, and when the actuator is operated, the outer sleeves 20 slide axially relative to the upright tubular supports 22. The frame 21 forms a guide assembly for guiding sliding movement of the wheelchair platform 18.

The linear actuator 26 is anchored on cross member 23 of the pivot bracket 19, between the upright tubular supports 22. The sleeves 20 are securely fastened together to form the frame 21. The sleeves have straps 29 fixed thereto which support upright rear walls 32 that are back stop walls of the wheelchair platform section 18. The platform section 18 also includes a support platform 34.

The pivot bracket 19 has a connection plate 36 which is fixed to the lower pivoting cross member 23. A pin 38 joins the extendible rod 39 of a linear actuator 40 to the plate 36. The linear actuator 40 is also a conventional ball screw actuator and has its base end pivotally anchored to a cross member 42 of the base or support frame 14, and a reversible DC motor 44 is used for extending and retracting the rod 39 of linear actuator 40 to move the pivot bracket 19, including the upright tubular supports 22 and thus the pivot frame 12 about the pivot axis of pin 17. The pivot frame 12 includes the telescoping frame 21 and the rear upright stop walls 32 and support platform 34. The support platform 34 has wheel support tracks 46 and a raised center portion 48 which as shown provides clearance for the linear actuators, motors, and a portable power source or battery 50. The tracks 46 have flanges 47 along the outer side edges which extend upwardly at the rear to form walls 47A to hold a wheelchair from sliding off.

Figure 1:
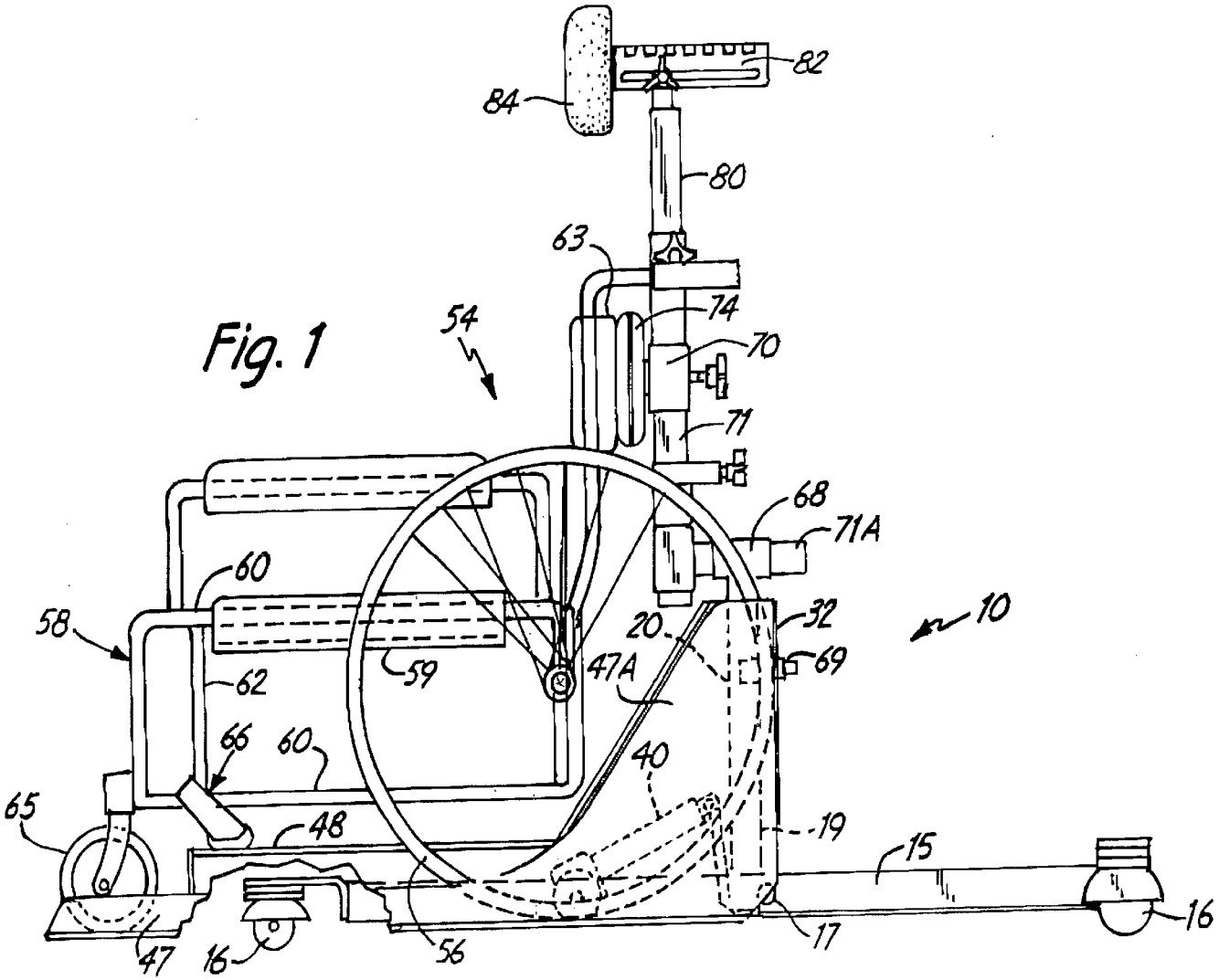
FIG. 1 is a side elevational view of the wheelchair of the present invention showing it in the lowered position.

When the platform 34 is lowered, a wheelchair 54 shown very schematically can be rolled onto the platform tracks 46 as shown in FIG. 1 and positioned between the flanges 47 and wall 47A with the rear wheels 56 of the wheelchair supported on the track 46 of platform 34 and against the upright rear wall member 32. The wheelchair frame 58, which is shown schematically, has horizontal members 60, and integral upright members 62. A strap or sling seat 59 is mounted across top frame member 60 and a sling back 63 is provided. Arm rests also are provided.

Mechanical clamps 69 are J shaped and can be clamped over the wheels and tightened down to securely hold the wheelchair in place. The clamps have threaded member with hand knobs at the back for securing them in place along slots 69A. The threaded members extend through the slots 69A. The clamps 69 provide for lateral adjustment to engage and hold the rear wheels 56 of the wheelchair 54 against the rear stop walls 32 and the platform tracks 46 to lock the wheelchair 54 securely in place.

Lock straps also can be used at junction 66 by front members 26 for holding the horizontal members 60 down onto the platform 34. The straps can be buckle type devices or velcro fastened straps that can be adjusted so that the wheelchair is securely fastened.

Figure 2:
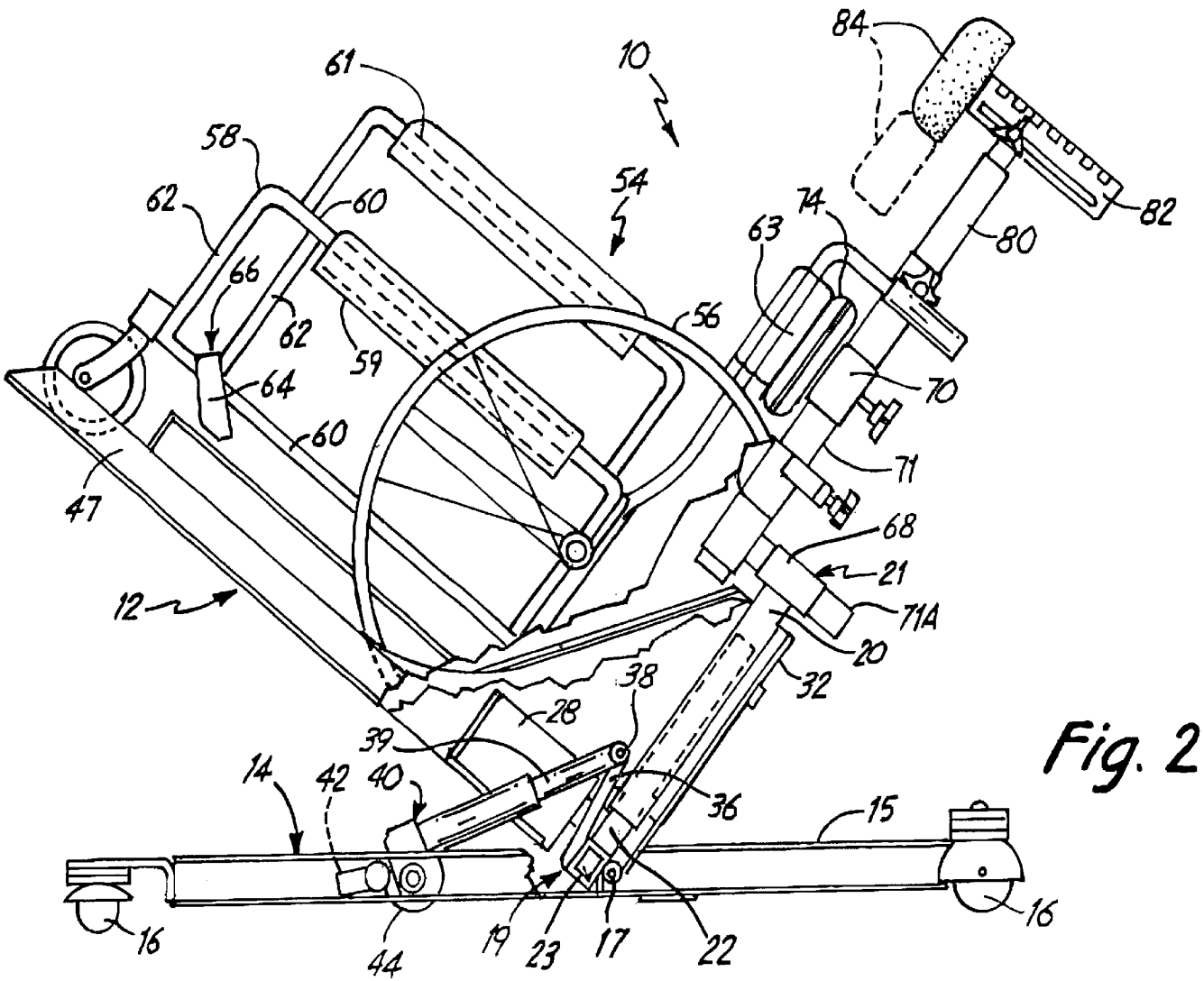
FIG. 2 is a side elevational view of the wheelchair of FIG. 1 shown in a tilted or raised position and with the platform elevated upwardly.

The sliding or telescoping frame 21 is adjustable in height with the linear actuator 26. It is to the rear of the wheelchair 54 that is placed on the support platform 34. The top cross member 25 has a cross sleeve 68 fixed thereto. The sleeve 68 adjustably supports an arm 71A that carries an upright tube 71. The tube 71 can be moved in and out along sleeve 68 and locked in place with a hand screw. A hub 70 can be placed over upright tube 71 for slidably supporting a backrest pad 74 that can be adjusted to bear on the sling backrest 63 on the wheelchair 54 and thus directly support an occupant of the chair. The backrest pad 74 is designed to provide for a very secure feeling for a patient or occupant when the wheelchair is tilted as shown in FIG. 2. The backrest pad 74 can be adjusted up and down and held in place with a hand operated screw. The support 71A permits in and out adjustment of the back rest and upright tube 71.

Additionally, a post 80 slides in upright tube 71. Post 80 supports a cross support 82 that has a head support 84 mounted thereon. The head support also can be adjusted in and out along post 80, in a generally horizontal direction, when the support platform 34 is horizontal. The adjustments on the sleeve 68 hub 70 and for post 80 can be hand operated set screws, which will thread relative to the outer wall of the sleeve or hub and will bear against the tubes to hold the components locked in their adjusted position. The head support pad 84 can be replaced with a drain pan for shampooing a patient, as shown in U.S. Pat. No. 4,834,411.

The motors 28 and 44 for linear actuators 26 and 40 can be electrically operated controllable DC reversible motors driving ball screws and operated with controls 81 in a normal manner. The linear actuators are purchased items available from several sources.

The wheelchair frame 58 also has caster front wheels 65, as shown, that caster about upright axes in a normal manner. There are four wheels on the wheelchair 54, the two large wheels 56 and the caster wheels 65, which support the wheelchair frame 58 and the occupant very securely. All four of the wheels are securely supported on the support platform 34 and the wheelchair is locked in position so that it will not shift. The back stop walls 32 hold the chair securely in place as the platform is tilted.

The center portion 48 fits between the wheelchair wheels 56 and 61, and clears the frame 14 when the wheelchair is in lowered position so that the wheelchair can be securely anchored in place using clamps 69. The front caster wheels 16 of the frame 14 are under the center portion 48 so they do not get in the way.

The unit is easily portable and easily used. It is compact and stable and permits rapidly positioning a chair in place and then tilting it for convenience in examining, treating or shampooing a patient.

Although the present invention has been described with reference to preferred embodiments, workers skilled in the art will recognize that changes may be made in form and detail without departing from the spirit and scope of the invention.

What is claimed is:

1. A tilting stand for supporting a wheelchair comprising a base frame, a plurality of wheels supporting said base frame, a platform having a pair of spaced apart wheel tracks for supporting the wheels of a wheelchair, said wheel tracks including a wheel support wall portion, and an upright stop walls at a rearward end of each track for engaging main wheels of a wheelchair to prevent rolling of a wheelchair rearwardly, a securing structure for holding the main wheels of a wheelchair against both the support wall portions and the stop walls, a pivot support between the platform and the base frame for pivotally mounting the platform relative to the base frame at a position rearwardly of the upright stop walls of the platform, and a power actuator positioned between the spaced wheel tracks forwardly of the pivot and connected to the base frame and the platform, and underlying a wheelchair on the platform, for controlling movement of the platform about the pivotal mounting to permit tilting the platform from a horizontal position to an inclined position where the platform inclines from a forward edge toward the stop walls.

2. The stand in claim 1, and a vertically adjustable frame between the platform and the base frame.

3. The stand in claim 1, and a vertically adjustable backrest for engaging a back of a wheelchair on the frame spaced upwardly from the platform for providing a back support for the chair.

4. The stand of claim 1, and an adjustable headrest for engaging a head of an occupant of a chair on the platform and providing a rearward support for the head.

5. The stand of claim 1 wherein the base includes an upright frame, the pivotal mounting comprising a pivot between the upright frame the base, a guide assembly fixed to the platform and slidably mounted on the upright frame, the power actuator comprising an electrically driven linear actuator and a motor at a forward end of the linear actuator and a second linear actuator for moving the guide assembly and the platform relative to the upright frame for changing the position of the platform relative to the base.

6. The stand of claim 1 and a pivot bracket pivotally mounted on the base frame for supporting the platform, the platform being slidably guided on the pivot bracket on the base frame for movement toward and away from the base frame, and a second power actuator between the platform and the bracket for moving the platform toward and away from the base frame.

7. The stand of claim 1, wherein the platform has a raised center portion overlying the power actuator and wherein the wheel tracks are along the sides of the raised center portion.

8. A reclining stand for a wheelchair having a frame, a pair of spaced large diameter rear wheels, and a pair of front support wheels, and said wheelchair having a seat and a backrest, the stand comprising a base frame having wheels for stably supporting the frame relative to a surface, a platform wall having wheel tracks for the wheelchair and upright stop wall portions generally perpendicular to the wheel tracks and fixed together so that the platform and upright wall portions move as a unit, a pivot frame secured to the platform for pivotally mounting the platform wall to the base frame about a generally horizontal pivot at a location to the rear of the upright stop wall portions, the wheel tracks having a width and length to support the wheels of a wheelchair, with the rear wheels on the platform wall engaging the stop wall portions, side walls attached to the outer sides of the tracks and tapering upwardly to be attached to upper portions of the upright wall portions, a power actuator for tilting the platform wall and stop wall portions relative to the base frame about the pivot axis of the pivotal mounting, and fasteners for holding a wheelchair relative to the platform wall and stop wall portions, the stop wall portion extending upwardly to a level above a center of rear wheels of a wheelchair so the fasteners secure the wheels of a wheelchair with wheels of the wheelchair engaging both the platform wall and the stop wall portions.

9. The stand of claim 8, and an adjustable mounting between the platform wall and the base frame to permit moving the platform wall in an upward direction relative to the base frame.

10. The stand of claim 8, and a backrest mounted on said platform wall for engaging a flexible back portion of the wheelchair and providing direct support to an occupant of the chair when a chair is on the platform wall and against the stop wall portions.

11. The stand of claim 8, and an adjustable headrest mounted for movement with the platform wall and being vertically adjustable to engage the rear of the head portion of an occupant seated in a chair on the platform wall.

12. The stand of claim 8, wherein said platform wall is tilted about said pivot with the power actuator, the power actuator being positioned below the platform and being positioned between the wheel tracks and forwardly of the pivot.

13. The stand of claim 8, wherein said wheels of said base frame comprise caster wheels.

14. The stand of claim 9, wherein the adjustable support comprises a upright frame, and a telescoping frame slidably mounted on the upright frame for movement toward and away from the base frame.

15. The stand of claim 14, and a vertically positioned actuator between the telescoping frame and the base frame for moving the telescoping frame relative to the upright frame.

16. A tilting stand for supporting a wheelchair comprising a base frame, a plurality of wheels supporting said base frame, a platform having a platform surface for supporting the wheels of a wheelchair, on a platform support wall portion, and upright stop walls for engaging main wheels of a wheelchair to prevent rolling of a chair, an upright frame, a guide assembly fixed to the platform to the rear of the stop walls and slidably mounted on the upright frame, a securing structure for holding the main wheels of a wheelchair against both the support wall portion and the stop wall, a pivot support between the upright frame and the base frame for pivotally mounting the upright frame and the platform relative to the base frame at a position rearwardly of the platform, a first linear actuator between the upright frame and the guide assembly for moving the guide assembly and the platform relative to the upright frame for changing the position of the platform relative to the base, and a second power actuator controlling movement of the upright frame about the pivotal mounting to permit tilting the platform from a horizontal position to an inclined position where the platform inclines from a forward edge toward the stop walls.

* * * * *

UNITED STATES PATENT AND TRADEMARK OFFICE

CERTIFICATE OF CORRECTION

PATENT NO. : 6,478,529 B1 
DATED : November 12, 2002
INVENTOR(S) : Leone V. Willey et al.

It is certified that error appears in the above-identified patent and that said Letters Patent is hereby corrected as shown below:

Column 4,
Line 45, after "frame" insert -- and --.

Signed and Sealed this

Eighteenth Day of January, 2005

JON W. DUDAS
*Director of the United States Patent and Trademark Office*